US009606488B1

(12) United States Patent
Leute et al.

(10) Patent No.: US 9,606,488 B1
(45) Date of Patent: Mar. 28, 2017

(54) SYSTEM FOR REFILLING REPLENISHER CARTRIDGE

(71) Applicant: Xerox Corporation, Norwalk, CT (US)

(72) Inventors: Gerardo Leute, Penfield, NY (US); Paul M. Wegman, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/000,502

(22) Filed: Jan. 19, 2016

(51) Int. Cl.
*G03G 15/00* (2006.01)

(52) U.S. Cl.
CPC ..... *G03G 15/556* (2013.01)

(58) Field of Classification Search
CPC ..... G03G 15/556; G03G 15/0894; G03G 21/181; G03G 2215/00987
USPC ..... 399/109
See application file for complete search history.

(56) References Cited

U.S. PATENT DOCUMENTS

| | | | | |
|---|---|---|---|---|
| 7,565,090 | B2 * | 7/2009 | Kamimura | G03G 15/0894 399/109 |
| 8,165,508 | B2 * | 4/2012 | Matsumoto | G03G 15/0822 399/258 |
| 2002/0110379 | A1 * | 8/2002 | Reihl | G03G 15/0894 399/12 |
| 2005/0028492 | A1 * | 2/2005 | Nagashima | B29C 65/08 53/471 |
| 2012/0321354 | A1 * | 12/2012 | Rapkin | G03G 15/0891 399/258 |

* cited by examiner

*Primary Examiner* — Sandra Brase
(74) *Attorney, Agent, or Firm* — Hoffman Warnick LLC

(57) ABSTRACT

The present teachings described a method and system of refilling replenisher containers for an electrophotographic machine. A replenisher cartridge for refill is received and a weight of the replenisher cartridge is determined. The weight of residual material in the replenisher cartridge is determined. The weight of carrier particles in the weight of residual material is determined through X-ray image analysis of the replenisher cartridge. The weight of carrier particles in the weight of residual materials and the weight of residual toner by is determined. An amount of toner and carrier is added to the replenisher cartridge.

20 Claims, 4 Drawing Sheets

SYSTEM FOR REFILLING REPLENISHER CARTRIDGE

BACKGROUND

Field of Use

The present invention relates to a developer apparatus for electrophotographic printing. More specifically, the invention relates to a system for refilling a replenisher cartridge.

Background

The present disclosure relates generally to toner image reproduction machines, and more particularly, concerns such a machine utilizing two component (carrier particles and toner particles) developer, and including a replenishment cartridge.

In a typical toner image reproduction machine, for example an electrophotographic printing process machine contained within a single enclosing frame, an imaging region of a toner image bearing member such as a photoconductive member is charged to a substantially uniform potential so as to sensitize the surface thereof. The charged portion of the photoconductive member is irradiated or exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed at a development station by bringing a developer material in a developer housing into contact therewith. Generally, the developer material comprises magnetic carrier particles and toner particles that adhere triboelectrically to carrier particles. During development, the toner particles are attracted from the carrier particles to the latent image, thereby forming a toner powder image on the photoconductive member. The toner powder image is then transferred from the photoconductive member to a copy sheet. The toner particles are then heated by a fusing apparatus within the single enclosed frame to permanently affix the powder image to the copy sheet.

Two-component developer material largely includes toner particles interspersed with carrier particles. The carrier particles are magnetically attractable, and the toner particles are caused to adhere triboelectrically to the carrier particles. This two-component developer can be conveyed, by means such as a "magnetic roll," to the electrostatic latent image, where toner particles become detached from the carrier particles and adhere to the electrostatic latent image.

Xerographic printers often use replenisher cartridges to supply both toner and carrier to the marking engine. When these cartridges are replaced by customers, they often contain residual or larger quantities of the toner:carrier mixture. When these cartridges are refilled, attaining the correct ratio in the refilled cartridge is difficult because the actual ratio in the residual material can vary.

It would be desirable to have a method of refilling replenishment cartridges that decreases waste and labor and provides filled replenishment cartridges that meet the toner and carrier fill weight specifications for the particular electrophotographic machine.

SUMMARY

According to an embodiment, there is provided a method of refilling a replenisher cartridge for an electrophotographic machine. The replenisher container contains toner and carrier particles. The method includes receiving a replenisher cartridge for refill and determining a weight of the replenisher cartridge. The method includes determining a weight of residual material in the replenisher cartridge by subtracting the weight of the replenisher cartridge from a reference empty replenisher cartridge weight. The method includes determining a weight of carrier particles in the weight of residual material by taking an X-ray image of the replenisher cartridge and calculating a percentage of carrier particles in the residual material by analyzing the X-ray image. The method includes calculating the weight of carrier particles in the weight of residual materials and determining a weight of residual toner by subtracting the weight of carrier particles in the residual material from the weight of residual material. The method includes adding an amount of toner to the replenisher cartridge determined by subtracting the weight of residual toner from a reference weight of toner for a filled replenisher cartridge and adding an amount carrier to the replenishment cartridge determined by subtracting the weight of residual metal from a reference weight of carrier for a filled replenisher cartridge.

There is provided a system for refilling a replenisher cartridge for an electrophotographic machine, the replenisher cartridge containing toner and carrier particles. The system includes at least one computing device, the at least one computing device configured to perform actions including receiving a weight of a replenisher cartridge for refill and determining the weight of residual material in the replenisher cartridge by subtracting the weight of the replenisher cartridge from a reference empty replenisher cartridge weight using at least one computing device. An X-ray image of the replenisher cartridge is received and analyzed to determine the mass of carrier particles in the residual material using the at least one computing device. In an alternate embodiment a magnetic field is applied to the replenisher cartridge. The weight of carrier particles in the residual material is determined from the magnetic force of the replenishment cartridge using the at least one computing device. The weight of carrier particles and toner in the weight of residual materials is determined using the at least one computing device. The weight of residual toner in the replenisher cartridge is determined. An amount of toner is added to the replenisher cartridge determined by subtracting the weight of residual toner from a reference weight of toner for a filled replenisher cartridge. An amount carrier is added to the replenishment cartridge determined by subtracting the weight of residual metal from a reference weight of carrier for a filled replenisher cartridge.

There is provided a method of refilling a replenisher cartridge for an electrophotographic machine, the replenisher cartridge containing toner and carrier particles. The method includes receiving a replenisher cartridge for refill and determining a weight of the replenisher cartridge. The method includes determining a weight of residual material in the replenisher cartridge by subtracting the weight of the replenisher cartridge from a reference empty replenisher cartridge weight. The method includes determining a weight of carrier particles in the weight of residual material by placing the replenisher cartridge in a magnetic field and determining the magnetic force of the replenisher cartridge for refill in the magnetic field. The method includes calculating the weight of carrier particles in the replenisher cartridge based on the measured magnetic force. The method includes determining a weight of residual toner by subtracting the weight of carrier particles in the residual material from the weight of residual material. The method includes adding an amount of toner to the replenisher cartridge determined by subtracting the weight of residual toner from a reference weight of toner for a filled replenisher cartridge and adding an amount carrier to the replenishment cartridge determined by subtracting the weight of residual metal from a reference weight of carrier for a filled replenisher cartridge.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the FIGS. have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific illustrative embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely illustrative.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
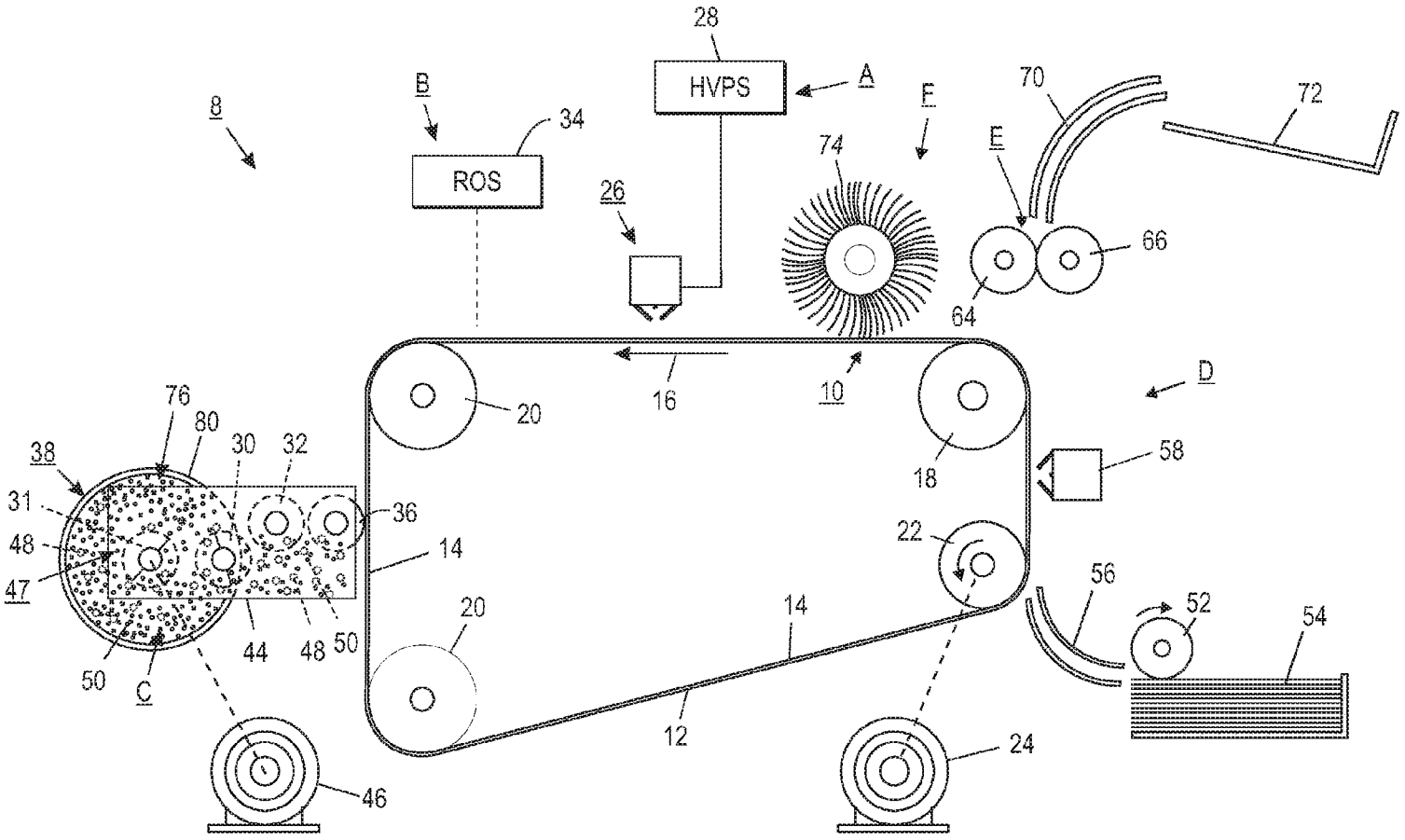
FIG. 1 illustrative an exemplary electrophotographic apparatus.

Referring initially to FIG. 1, there is shown an illustrative electrophotographic printing machine 8 incorporating the replenishment supply cartridge 80 therein. The printing machine incorporates a photoreceptor 10 in the form of a belt having a photoconductive surface layer 12 on an electroconductive substrate 14. The surface 12 is made from a selenium alloy or a suitable photosensitive organic compound. The substrate 14 may be made from a polyester film such as MYLAR® (a trademark of DuPont (UK) Ltd.) which has been coated with a thin layer of aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, electrical potential. A high voltage power supply 28 is coupled to device 26.

The charged portion of photoconductive surface 12 is advanced through exposure station B. At exposure station B, the raster output scanner (ROS) 34 lays out the image in a series of horizontal scan lines with each line having a specified number of pixels per inch. The ROS 34 includes a laser and a rotating polygon mirror block associated therewith. The ROS 34 exposes the charged photoconductive surface 12 of the photoreceptor 10.

After the electrostatic latent image has been recorded on photoconductive surface 12, the motion of the belt 10 advances the latent image to development station C as shown in FIG. 1. At development station C, one or more development systems 38, develops the latent image recorded on the photoconductive surface 12. The chamber in developer housing 44 stores a supply of developer material 47. The developer material 47 is, as shown in FIG. 1, a two component developer material of at least magnetic carrier granules 48 having toner particles 50 adhering triboelectrically thereto.

Again referring to FIG. 1, after the electrostatic latent image has been developed, the motion of the belt 10 advances the developed image to transfer station D, at which a copy sheet 54 is advanced by roll 52 and guides 56 into contact with the developed image on belt 10. A corona generator 58 is used to spray ions onto the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine 8 by the operator.

After the sheet is separated from photoconductive surface 12 of belt 10, the residual developer material adhering to photoconductive surface 12 is removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the replenishment cartridge 80 replacement system disclosed herein.

Referring again to FIG. 1, in order to provide a constant supply of at least toner 50 to replace that consumed in the developing of the latent image, the development systems 38 include a cartridge 80 for storing a replaceable supply of replenisher 76 in a replenisher supply source, such as a replenisher bottle, including at least toner 50 and carrier particles 48.

The cartridge 80 is a replaceable item that can be made of any suitable durable material. The illustrated cartridge 80 is configured to mate with a specific electrophotographic machine. The cartridge may include an auger for mixing or transporting the replenisher or the cartridge may be shaped to improve flowability of the replenisher.

The overall function of development system 38 is to apply marking material, such as toner, onto suitably-charged areas forming a latent image on an image receptor such as photoreceptor belt 10 (a portion of which is shown), in a manner generally known in the art. In various types of printers, there may be multiple such developer systems 38, such as one for each primary color or other purpose.

Among the elements of the developer system 38 shown in FIG. 1, which are typical of developer systems of various types, are a developer housing 44, which functions generally to hold a supply of developer material 47, and a magnetic roll 36, which in this embodiment forms a magnetic brush to apply toner 50 extracted from the developer material 47 to the photoreceptor 10. A motor 46 is illustrated that is coupled to provide rotational motion to the various augers 30, 31, 32, the replenishment cartridge 80 coupled to auger 31 and the magnetic roll 36. Those skilled in the art will recognize that the various augers 30, 31, 32, the replenishment cartridge 80 coupled to auger 31 and the magnetic roll 36 may be driven by separate motors or may be driven by motor 24 within the scope of the disclosure.

Other types of features for development of latent images, such as donor rolls, paddles, scavengeless-development electrodes, commutators, etc., are known in the art and could be used in conjunction with various embodiments pursuant to the claims. While the illustrated embodiment shows only one magnetic roll 36, it is common for developer units to include two or more magnetic rolls. As mentioned above, in many embodiments of developer systems 38, a two-component developer material 47 is used, comprising toner 50 and carrier 48.

In "trickle" type development systems 38 as described above, but also in other types of developer systems, there is provided a replenisher supply source such as a replenishment cartridge 80 which is filled with a developer material replenisher 76 including toner 50 and carrier 48. In the present embodiment, the replenishment cartridge 80 is disposed near an auger 31 and in communication therewith. The auger 31 is a component of the replenisher transporter which is also in communication with the interior of the developer housing 44. In electrophotographic imaging, developer compositions may comprise one or more toner compositions and one or more carrier compositions. Developers are be generated by mixing carrier with toner.

The replenishment cartridge 80 is removed when empty as determined by the electrophotographic machine and a full replenishment cartridge is installed. The empty cartridge, which has a quantity of residual toner and carrier is returned for refilling.

Disclosed herein is a system for refilled returned replenishment cartridges. The returned replenishment cartridge is weighed on the filling line, and the average weight of the empty cartridge (from historical samples) is subtracted to determine the net weight of the residual replenisher within the replenishment cartridge. The replenishment cartridge is also examined using an X-ray or other imaging device to determine how much carrier and toner is present in the residual replenisher. By determining the quantity of metal in the residual replenisher, the quantity of carrier in the residual replenisher is calculated. The quantity of toner in the residual replenisher is calculated, and the balances of carrier and toner needed to fill the cartridge to meet the specification are determined. The toner and carrier fill quantities are then dispensed into the cartridge, which is then sealed, packaged, and made ready for distribution.

Figure 2:
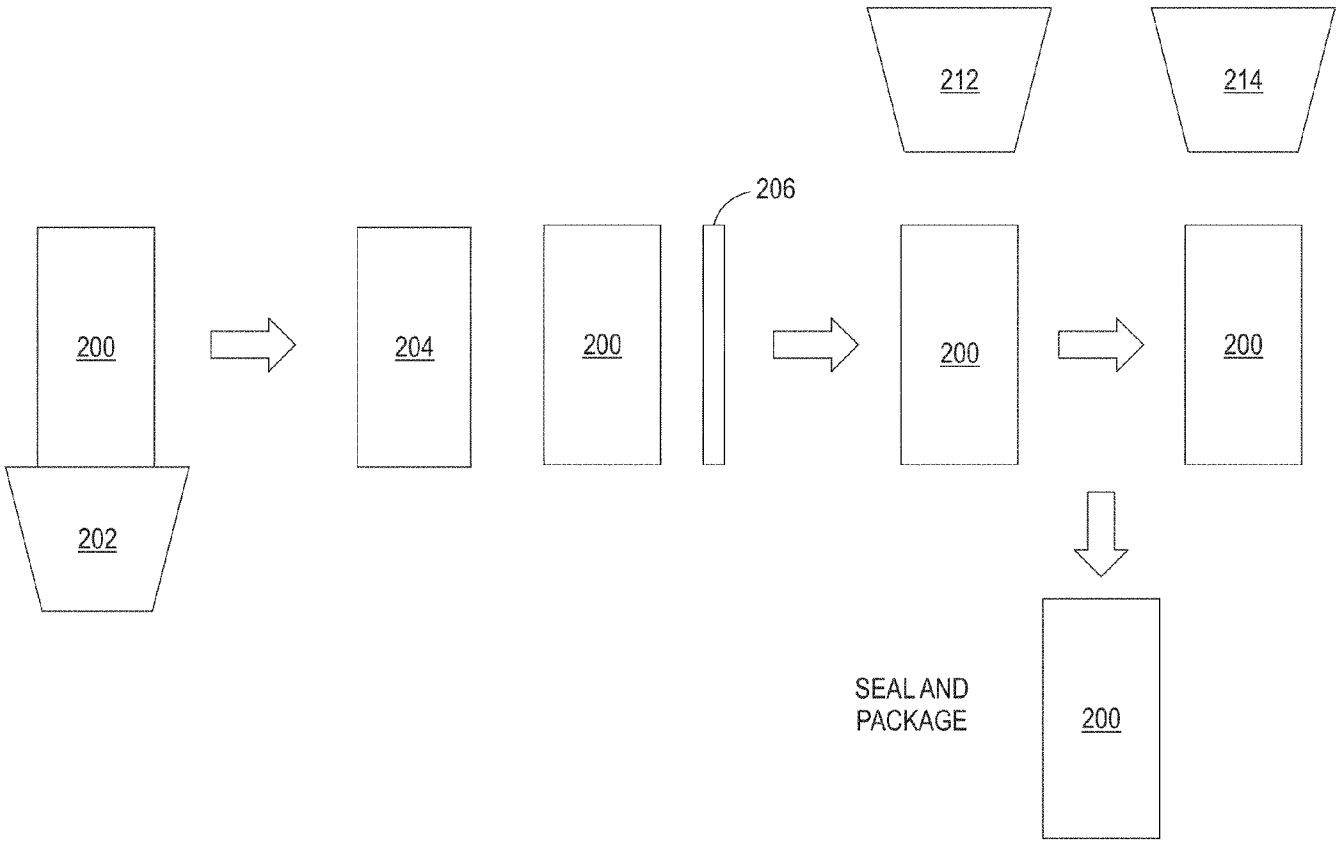
FIG. 2 is a diagram of the work flow for refilling replenishment cartridges.

Shown in FIG. 2 is the process flow for the system of refilling replenishment cartridges disclosed herein. The replenishment cartridge 200 that is to be refilled is unsealed and placed on the production line and weighed using an in-line load cell 202. Using a reference empty replenishment cartridge weight or tare weight, the net weight of residual material in the cartridge is calculated by subtracting the reference empty replenishment cartridge weight from the replenishment cartridge weight. An X-ray device 204 irradiates the replenishment cartridge 200 to be refilled which generates an image 206 of the replenishment cartridge 200 to be refilled. The image 206 is analyzed through signal processing software to determine the percent of carrier particles in the image 206 of the residual material. This is possible since the carrier is comprised of metal particles and metal is detected by the x-ray scattered imaging. The image will be digital and therefore comprised of pixels. The pixels from the image will be colored based on the quantity of carrier present. A pixel with carrier present will have a different color depending on whether carrier is present or not. The pixel is then compared to a known reference in order to determine the quantity of carrier. The process of pixel comparison continues until the image is fully analyzed. The weight of carrier particles in the residual material is then determined. The result of the analysis determines the carrier quantity present in the replenishment cartridge, netting out any metal that the cartridge might contain (augers, customer replaceable unit monitor (CRUM) etc.). The quantities of toner and carrier to be added to the cartridge to reach the target toner and target carrier weights are calculated. The replenishment cartridge 200 that is to be refilled is unsealed and is transferred to a carrier filling station 212 and toner refilling station 214. Carrier and toner quantities are added to the replenishment cartridge 200. The amount of carrier added to the replenishment cartridge is determined by subtracting the residual carrier weight in the cartridge from the reference carrier weight of the replenishment cartridge. Likewise, the toner added is determined by subtracting the residual toner weight in the cartridge from the reference toner weight of the replenishment cartridge. The refilled replenishment cartridge is ready for sealing and packaging and is then ready for shipment to a customer.

Figure 3:
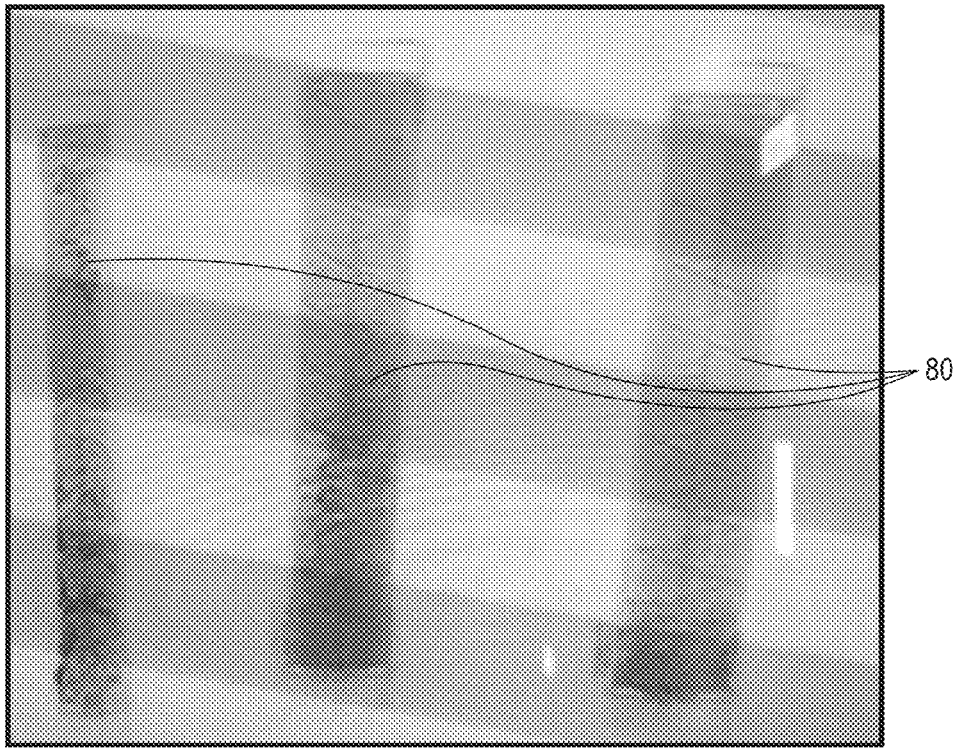
FIG. 3 is an X-ray image of a returned replenishment cartridge.

The carrier detection and measurement process utilizes an X-ray or similar device to provide an image of the carrier (metal) in the residual replenisher in the cartridge. Typical x-ray images of various cartridge types are shown in FIG. 3. Using the cartridge image, an image recognition application captures the areas of carrier within the residual replenisher in the replenisher cartridge. Using shape and color recognition, the amount of carrier is then be calculated.

An alternate embodiment is described which uses magnetic force to determine the residual amount of carrier particles. The method for carrier detection using magnetic detection is possible as carrier particles are magnetic. In this embodiment rather than an X-ray device 204 as shown in FIG. 2, a cartridge 200 is placed in a magnetic field and the force of the replenishment cartridge in the magnetic field is determined. The magnetic force directly correlates with the amount of carrier particles in the replenishment cartridge for refill. The result of the analysis determines the carrier quantity present in the replenishment cartridge, netting out any magnetic items that the cartridge might contain (augers, customer replaceable unit monitor ((CRUM) etc.). The quantities of toner and carrier to be added to the cartridge to reach the target toner and target carrier weights are calculated. The replenishment cartridge 200 to be refilled is transferred to a carrier filling station 212 and toner refilling station 214. Carrier and toner quantities are added to the replenishment cartridge 200. The amount of carrier added to the replenishment cartridge is determined by subtracting the residual carrier weight in the cartridge from the reference carrier weight of the replenishment cartridge. Likewise, the toner added is determined by subtracting the residual toner weight in the cartridge from the reference toner weight of the replenishment cartridge. The refilled replenishment cartridge is ready for sealing and packaging and is then ready for shipment to a customer.

Toner compositions that may be used in accordance with embodiments are not particularly limited and should be readily understood by those of skill in the art. Illustrative examples of suitable toner resins for use in embodiments of the developer compositions include polyamides, epoxies, polyurethanes, diolefins, vinyl resins, styrene acrylates, styrene methacrylates, styrene butadienes, polyesters such as the polymeric esterification products of a dicarboxylic acid and a diol comprising a diphenol, cross linked polyesters, and the like. Specific vinyl monomers include styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like. Also, there may be selected styrene butadiene copolymers, mixtures thereof, and the like.

Carrier particles typically include a metal core. Examples of carrier cores that may be selected include iron, steel, ferrites, magnetite, nickel, and mixtures thereof. The carrier cores of some preferred embodiments are magnetite. The core particles preferably have an average particle diameter of from about 25 to about 100 microns, more preferably about 60 to about 70 microns, most preferably about 65 microns as determined by standard laser diffraction techniques. The carrier particles can include a polymeric coating. The carrier coatings are present in an amount of from about 0.1 to about 2.0 percent by weight of the carrier particle, including from about 0.3 to about 1.0 percent by weight of the carrier particle, further including from about 0.3 to about 0.8 percent by weight of the carrier particle, although other amounts are suitable provided that the objectives of the present disclosure are achieved. Coated carrier particles generally may have diameter of, for example, from about 25 to about 1,000 microns, and from about 40 to about 150 microns, thus allowing these particles to possess sufficient density and inertia to avoid adherence to the electrostatic image during the development process.

FIG. 3 shows examples of returned replenishment cartridges 80. Each of the cartridges 80 has green areas and orange areas in color images. In the black and white images of FIG. 3, the grey shading shows the difference. The darker areas represent the green in the black and white images. With a color X-ray image, the pixels of a color associated with the carrier can be determined. The percent or fraction of pixels corresponding to the carrier is then determined which provides the percent or fraction of metal in the returned replenisher cartridge. From this the percent or fraction of metal, the fraction or percent of carrier is determined and the weight of carrier in the returned cartridge is calculated from the residual weight remaining in the returned cartridge.

Figure 4:
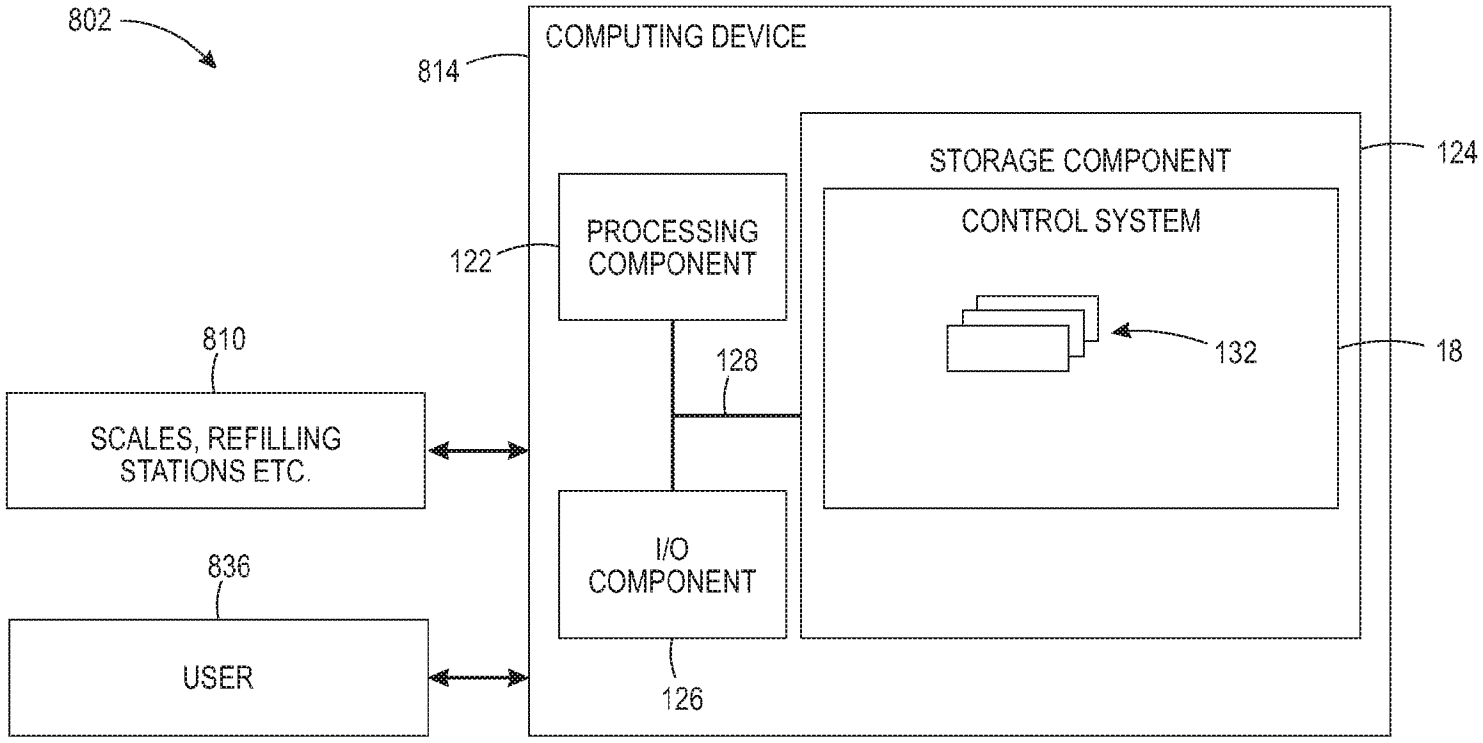
FIG. 4 shows an illustrative environment including a control system according to the disclosure herein.

FIG. 4 shows an illustrative environment 802 demonstrating at least one computing device 814 coupled to the scales, the toner dispenser and carrier dispenser 810. The computing device can be configured (e.g., programmed) to perform functions such as moving the replenisher cartridge along a production line to unseal weigh, image, fill, seal and package the replenishment cartridge.

The system 802 can also include at least one computing device 814 operably connected (e.g., hard-wired and/or wirelessly) to the scale 202, the imaging device 204 and the carrier refilling station 212 and toner refilling station 214 in FIG. 2.

Further, computing device 814 is shown in communication with a user 836. A user 836 may be, for example, a programmer or operator. Interactions between these components and computing device 814 and the user 836 include feeding inputs of replenishment cartridge identifier, weights, when the replenishment cartridge is placed at a refilling station, etc.

As noted herein, one or more of the processes described herein can be performed, e.g., by at least one computing device, such as computing device 814, as described herein. In other cases, one or more of these processes can be performed according to a computer-implemented method. In still other embodiments, one or more of these processes can be performed by executing computer program code on at least one computing device (e.g., computing device 814), causing the at least one computing device to perform a process, e.g., weighing a returned replenishment cartridge, imaging a replenishment cartridge etc.

In further detail, computing device 814 is shown including a processing component 122 (e.g., one or more processors), a storage component 124 (e.g., a storage hierarchy), an input/output (I/O) component 126 (e.g., one or more I/O interfaces and/or devices), and a communications pathway 128. In one embodiment, processing component 122 executes program code, which is at least partially embodied in storage component 124. While executing program code, processing component 122 can process data, which can result in reading and/or writing the data to/from storage component 124 and/or I/O component 126 for further processing. Pathway 128 provides a communications link between each of the components in computing device 814. I/O component 126 can comprise one or more human I/O devices or storage devices, which enable user 836 to interact with computing device 814 and/or one or more communications devices to enable user 836 to communicate with computing device 814 using any type of communications link.

In any event, computing device 814 can comprise one or more general purpose computing articles of manufacture (e.g., computing devices) capable of executing program code installed thereon. As used herein, it is understood that "program code" means any collection of instructions, in any language, code or notation, that cause a computing device having an information processing capability to perform a particular function either directly or after any combination of the following: (a) conversion to another language, code or notation; (b) reproduction in a different material form; and/or (c) decompression.

Further, the system can be implemented using a set of modules 132 in computing device 8114. In this case, a module 132 can enable computing device 814 to perform a set of tasks. The system may include modules 132 which include a specific use machine/hardware and/or software. Regardless, it is understood that two or more modules, and/or systems may share some/all of their respective hardware and/or software. Further, it is understood that some of the functionality discussed herein may not be implemented or additional functionality may be included as part of computing device 814.

When computing device 814 includes multiple computing devices, each computing device may have only a portion of system embodied thereon (e.g., one or more modules 132). However, it is understood that computing device 814 are only representative of various possible equivalent computer systems that may perform a process described herein. To this extent, in other embodiments, the functionality provided by computing device 814 can be at least partially implemented by one or more computing devices that include any combination of general and/or specific purpose hardware with or without program code. In each embodiment, the hardware and program code, if included, can be created using standard engineering and programming techniques, respectively.

Regardless, when computing device 814 includes multiple computing devices, the computing devices can communicate over any type of communications link. Further, while performing a process described herein, computing device 814 can communicate with one or more other computer systems using any type of communications link. In either case, the communications link can comprise any combination of various types of wired and/or wireless links; comprise any combination of one or more types of networks; and/or utilize any combination of various types of transmission techniques and protocols.

It is understood that in the flow diagram shown and described herein, other processes may be performed while not being shown, and the order of processes can be rearranged according to various embodiments. Additionally, intermediate processes may be performed between one or more described processes. The flow of processes shown and described herein is not to be construed as limiting of the various embodiments.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

It will be appreciated that variants of the above-disclosed and other features and functions or alternatives thereof may be combined into other different systems or applications. Various presently unforeseen or unanticipated alternatives, modifications, variations, or improvements therein may be subsequently made by those skilled in the art, which are also encompassed by the following claims.

What is claimed is:

1. A method of refilling a replenisher cartridge for an electrophotographic machine, the replenisher container containing toner and carrier particles, the method comprising:

receiving a replenisher cartridge for refill;

determining a weight of the replenisher cartridge;

determining a weight of residual material in the replenisher cartridge by subtracting the weight of the replenisher cartridge from a reference empty replenisher cartridge weight;

determining a weight of carrier particles in the weight of residual material by;

taking an X-ray image of the replenisher cartridge;

calculating a percentage of carrier particles in the residual material by analyzing the X-ray image; and calculating a weight of carrier particles in the weight of residual materials;

determining a weight of residual toner by subtracting the weight of carrier particles in the residual material from the weight of residual material;

adding an amount of toner to the replenisher cartridge determined by subtracting the weight of residual toner from a reference weight of toner for a filled replenisher cartridge; and adding an amount of carrier particles to the replenishment cartridge determined by subtracting the weight of residual metal from a reference weight of carrier particles for a filled replenisher cartridge.

2. The method of claim 1, wherein the carrier particles comprise a material selected from the group consisting of: iron, steel, ferrite, magnetite and nickel.

3. The method of claim 1, wherein the toner comprises a material selected from the group consisting of: polyamides, epoxies, polyurethanes, diolefins, vinyl resins, styrene acrylates, styrene methacrylates, styrene butadienes and polyesters.

4. The method of claim 1, wherein calculating a percentage of carrier particles in the residual material by analyzing the X-ray image comprises:

determining an amount of pixels associated with carrier particles in the X-ray image of the replenishment cartridge for refill;

determining a total amount of pixels in the X-ray image of the replenishment cartridge for refill; and determining the percentage of carrier particles in the X-ray image of the replenishment cartridge for refill which corresponds to the percentage of carrier particles in the residual material.

5. The method of claim 4, wherein pixels associated with the carrier particles in the X-ray image have a different color than pixels associated with the toner particles.

6. The method of claim 1, further comprising sealing the replenishment cartridge for refill.

7. The method of claim 6, further comprising packaging the sealed replenishment cartridge for refill.

8. The method of claim 1, wherein the adding an amount of toner and adding an amount of carrier is performed at a single station.

9. A system for refilling a replenisher cartridge for an electrophotographic machine, the replenisher container containing toner and carrier particles, the system comprising:

at least one computing device, the at least one computing device configured to perform actions including:

receiving a weight of a replenisher cartridge for refill;

determining the a weight of residual material in the replenisher cartridge by subtracting the weight of the replenisher cartridge from a reference empty replenisher cartridge weight using the at least one computing device;

receiving an X-ray image of the replenisher cartridge or a magnetic force of the replenisher cartridge when placed in a magnetic field;

determining a weight of carrier particles in the residual material through analysis of the X-ray image or the magnetic force using the at least one computing device;

determining the weight of carrier particles in the weight of residual materials using the at least one computing device;

determining a weight of residual toner in the replenisher cartridge by subtracting the weight of carrier particles from the weight residual of residual material;

adding an amount of toner to the replenisher cartridge determined by subtracting the weight of residual toner from a reference weight of toner for a filled replenisher cartridge; and adding an amount carrier particles to the replenishment cartridge determined by subtracting the weight of residual metal from a reference weight of carrier particles for a filled replenisher cartridge.

10. The system of claim 9, wherein determining the weight of carrier particles in the residual material by analyzing the X-ray image comprises:

determining an amount of pixels associated with the carrier particles in the X-ray image of the replenishment cartridge for refill;

determining a total amount of pixels in the X-ray image of the replenishment cartridge; and determining the percentage of carrier particles in the X-ray image of the replenishment cartridge which corresponds to the percentage of carrier particles in the residual material.

11. The system of claim 9, wherein determining the weight of carrier particles in the residual material by analyzing the magnetic force comprises:

determining the magnetic force of the replenisher cartridge in the magnetic field; and calculating the weight of carrier particles in the replenisher cartridge from the magnetic force.

12. The system of claim 9, further comprising sealing the replenishment cartridge.

13. The method of claim 12, further comprising packaging the sealed replenishment cartridge.

14. A method of refilling a replenisher cartridge for an electrophotographic machine, the replenisher container containing toner and carrier particles, the method comprising:

receiving a replenisher cartridge for refill;

determining a weight of the replenisher cartridge;

determining a weight of residual material in the replenisher cartridge by subtracting the weight of the replenisher cartridge from a reference empty replenisher cartridge weight;

determining a weight of carrier particles in the weight of residual material by:

placing the replenisher cartridge in a magnetic field;

determining the magnetic force of the replenisher cartridge in the magnetic field; and calculating a weight of carrier particles in the replenisher cartridge;

determining a weight of residual toner by subtracting the weight of carrier particles in the residual material from the weight of residual material;

adding an amount of toner to the replenisher cartridge determined by subtracting the weight of residual toner from a reference weight of toner for a filled replenisher cartridge; and adding an amount carrier particles to the replenishment cartridge determined by subtracting the weight of residual metal from a reference weight of carrier particles for a filled replenisher cartridge.

15. The method of claim 14, wherein the magnetic force is lowered by netting out any magnetic items selected from the group consisting of: augers and customer replaceable unit monitor that are in the replenishment cartridge.

16. The method of claim 14, further comprising sealing the replenishment cartridge.

17. The method of claim 14, further comprising packaging the sealed replenishment cartridge.

18. The method of claim 14, wherein the carrier particles comprise of a material selected from the group consisting of: iron, steel, ferrite, magnetite and nickel.

19. The method of claim 14, wherein the toner comprises a material selected from the group consisting of: polyamides, epoxies, polyurethanes, diolefins, vinyl resins, styrene acrylates, styrene methacrylates, styrene butadienes and polyesters.

20. The method of claim 14, wherein the adding an amount of toner and adding an amount of carrier is performed at a single station.

* * * * *